United States Patent [19]

Hellerqvist, deceased et al.

[11] 4,221,631

[45] Sep. 9, 1980

[54] METHOD AND APPARATUS FOR REFINING FIBEROUS MATERIAL

[75] Inventors: Gustaf R. Hellerqvist, deceased, late of Sundsvall, Sweden; Ingeborg H. C. Hellerqvist, legal representative, Stockholm, Sweden

[73] Assignee: SCA Development Aktiebolag, Sweden

[21] Appl. No.: 933,999

[22] Filed: Aug. 16, 1978

[30] Foreign Application Priority Data

Sep. 30, 1977 [DE] Fed. Rep. of Germany ..... 7710948

[51] Int. Cl.[2] ..... D21B 1/12

[52] U.S. Cl. ..... 162/23; 162/28; 241/28; 241/244

[58] Field of Search ..... 162/23, 28; 241/28, 241/244, 245, 246, 247, 248

[56] References Cited

FOREIGN PATENT DOCUMENTS 974958 9/1975 Canada ..... 162/28
371654 11/1974 Sweden .
416431 6/1974 U.S.S.R. ..... 241/244
486101 12/1975 U.S.S.R. ..... 241/245

*Primary Examiner*—William F. Smith
*Attorney, Agent, or Firm*—Lerner, David, Littenberg & Samuel

[57] ABSTRACT

Method and apparatus for refining fiberous material in a disc refiner for withdrawing steam developed during refining of such fiberous material. The disc refinger comprises a pair of refining discs each of which includes a inner refining surface. The refining discs are mounted for rotation relative to one another in a housing with the refining surfaces opposing one another during the relative rotation and defining a refining space therebetween. Each of the refining surfaces of the refining discs is provided with a passageway for withdrawing steam developed in the refining space. The passageways extend from the respective refining surfaces in a direction away from the refining space and radially inward relative to the direction that the fiberous material moves through the refining space.

16 Claims, 5 Drawing Figures

METHOD AND APPARATUS FOR REFINING FIBEROUS MATERIAL

BACKGROUND OF THE INVENTION

The present invention relates to a method and apparatus for refining fiberous material in a disc refiner and more particularly, to a method and apparatus for withdrawing steam developed during refining of fiberous material.

Disc refiners for refining of fiberous material, such as cellulose pulp, generally comprise two rotating refining discs which are supported for counter-rotation with respect to one another in a grinding or refining housing. The fiberous material to be refined is passed into the space between the two discs and is refined as it passes radially outward through the refining space between the two discs. Generally, the fiberous material is supplied in the form of chips through appropriate openings located close to the center of one of the refining discs. Generally, these chips especially in the refining of cellulose pulp, include water as the chips are usually steamed with hot water and/or steam before being introduced into the space between the two counter rotating discs. Further, water may be supplied in connection with the refining.

From this water, great amounts of steam are generated as energy is added during the refining operation on the fiberous material. This steam passes out of the refining space together with the refined material as well flowing rearward to a location where the chips are fed. The steam flowing outward together with the fiberous material through the refining space assumes a very high speed, often on the order of 150 to 1,000 meters per second, which as can be appreciated, disturbingly affects the material flow. Further, the steam may flow out in a jerky manner and thereby affect the stability of the grinding or refining gap, and simultaneously render the material flow through the gap nonuniform. This has a negative affect on the pulp quality.

Prior efforts to alleviate the problems associated with the generation of steam between the refining discs have involved withdrawing of steam from the central space between the refining discs. For example, Canadian Pat. No. 974,958, issued Sept. 23, 1975, for "Apparatus for Treatment of Cellulose Containing Material" discloses an apparatus and method in which steam generated during refining is withdrawn and discharged into the housing surrounding the refining discs through central openings close to the axis of rotation of the refining disc. That is, steam is withdrawn through openings arranged radially inward of the feed opening for the cellulose chips being introduced between the refining discs. While such arrangements have helped to relieve some of the problems associated with the generated steam, they have not been totally satisfactory, especially with respect to maintaining the stability of the refining gap and to assuring a uniform flow of material therethrough.

SUMMARY OF THE INVENTION

The present invention overcomes these and other disadvantages of the prior art. The method in accordance with the present invention relates to refining of fiberous material in a disc refiner of the type having a pair of refining discs each of which includes an inner refining surface, and in which the refining discs are mounted for rotation relative to one another within a housing with the inner refining surfaces opposing one another during the relative rotation and defining a refining space therebetween. The fiberous material is fed between the refining discs and the refining discs are rotated relative to one another so that fiberous material fed therebetween passes radially outward through the refining space into the housing. At least a portion of the steam developed in the refining space is withdrawn from the refining space through a passageway provided in at least one of the refining surfaces, the passageway extending from the refining surfaces in a direction away from the refining space. The withdrawn steam is then passed into the housing surrounding the refining discs without passing through the refining space.

In this way, steam generated in the refining space between the refining surfaces of the refining discs is withdrawn through the refining surfaces to thereby reduce the steam overflow through the refining space. Thus, the steam is removed directly from the area which is most unfavorably and disadvantageously affected by such steam-that is, at the location of the refining surfaces. Thus, the over pressurization in the refining space caused by the steam in such area is considerably reduced such that the force required to hold and maintain the refining discs adjacent to one another is much lower. Consequently, the energy expended during refining can instead be transferred to refining of the material rather than to maintaining a desired gap between the refining discs.

In the preferred embodiment, passageways are provided in each of the refining surfaces of the refining discs and extend in a direction radially inward relative to the direction of movement of the material outward through the refining space. In this way, the generated steam may be withdrawn without also withdrawing substantial quantities of unrefined fiberous material.

Accordingly to the apparatus of the present invention, at least one of the refining discs of a disc refiner is provided with a passageway extending from the refining surface thereof in a direction away from the refining space. Communication means are provided for passing the withdrawn steam from the passageway into the housing surrounding the refining discs without passing through the refining space. The passageway extending from the refining surface may comprise an annular passageway or slit which is concentrically arranged with respect to the refining discs or alternatively may comprise a plurality of holes located on the refining surface in a concentric pattern with respect to the refining disc.

Further, in the preferred embodiment, the passageway extends in a direction from the refining surface to form an angle of between 30° to 60° with the plane of the refining surface so that the withdrawn steam is directed radially inward relative to the direction of flow of the fiberous material through the refining space.

These and other other advantages and characteristics of the present invention will be apparent from the following detailed description in which reference is made to the enclosed drawings which illustrate a preferred embodiment of the present invention.

DETAILED DESCRIPTION OF THE INVENTION

Figure 1:
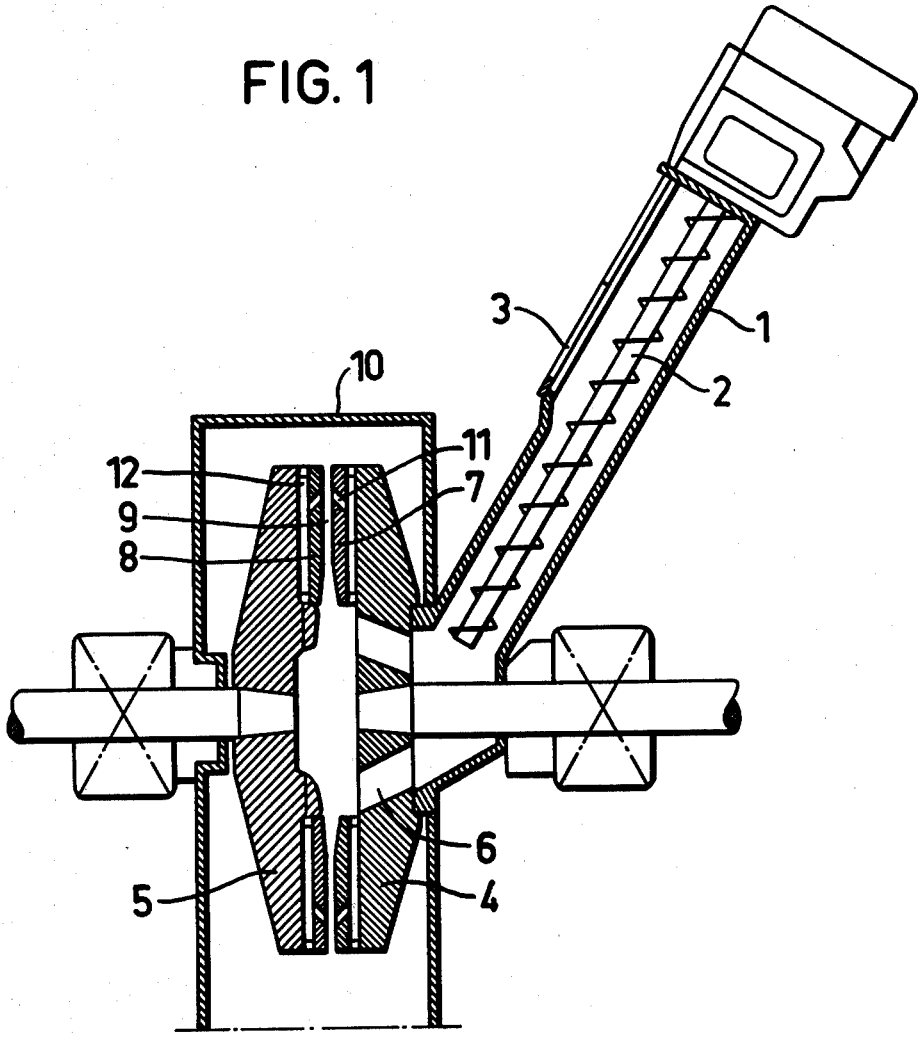
FIG. 1 is a schematic representation, partly in section, of a disc refiner according to the present invention.

The disc refiner according to FIG. 1 comprises a feed device 1 provided with one screw or screws 2. The fiberous material to be refined, such as for example, cellulose pulp, is supplied into the screw through an appropriate opening 3. The feed device 1 feeds the fiberous material in between two counter-rotating grinding or refining discs 4, 5 through openings 6 near the center of one refining disc 4. The refining discs 4, 5 are annular in shape and are each provided with refining segments or surfaces 7, 8 defining the refining gap or space 9 between the refining discs 4, 5. The refining discs 4, 5 are enclosed by a housing 10 receiving the refined fiberous material.

The refining segments 7, 8 are provided on their surface with a pattern of elevations and depressions for separating and treating the fibers. According to the invention, the refining segments further are provided with passageways 11 extending through the segments from the refining space 9 to the rear surface of the segments where a passageway 12 opens outward into the refining housing 10. Together, the passageways 11 and 12 comprise conducting means for removing steam developed in the refining space 9 and conducting it directly into the housing 10.

Figure 4:
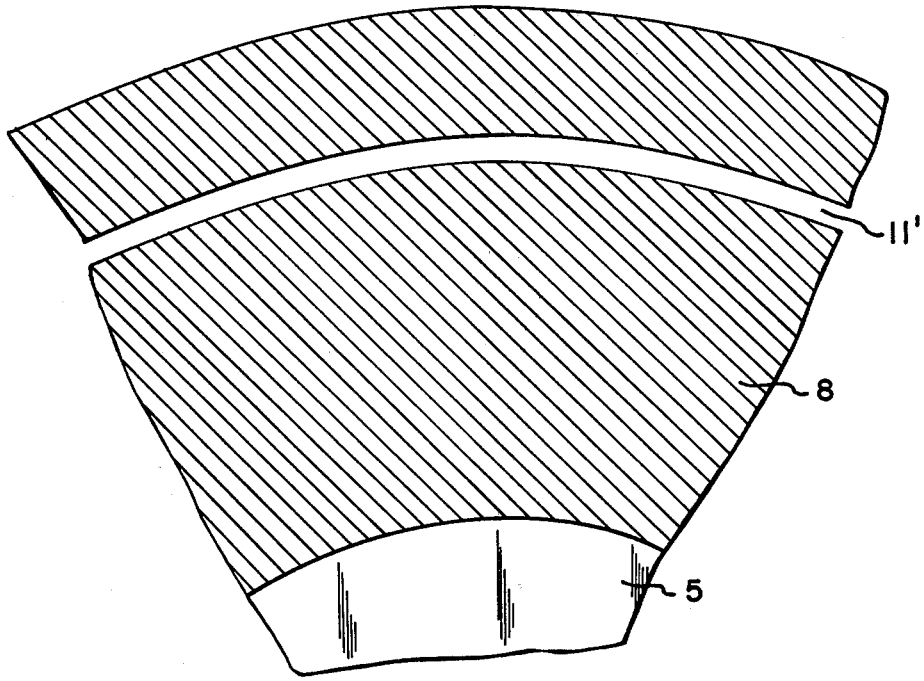
FIG. 4 is a partial sectional view taken along lines 4—4 of FIG. 2 showing one preferred arrangement for the passageways for steam removal.
Figure 5:
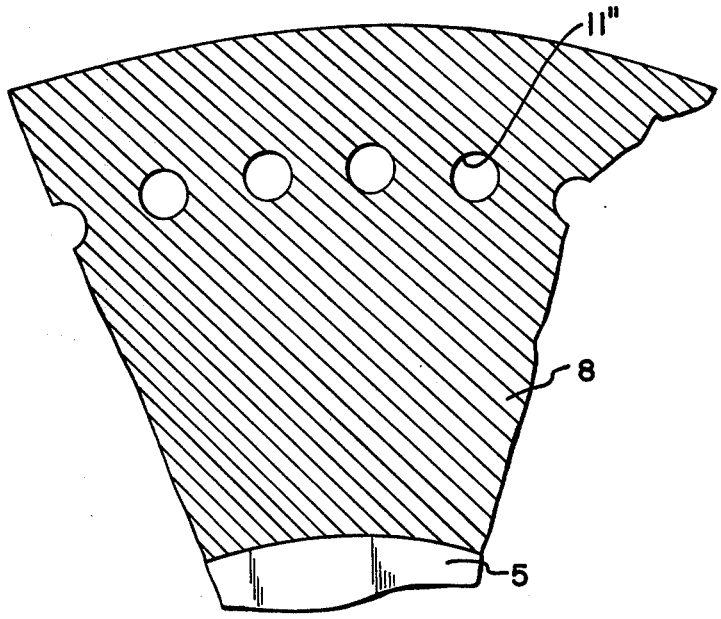
FIG. 5 is a partial sectional view, similar to FIG. 4, showing an alternate arrangement for the passageways for steam removal.

The passageways 11 in the refining surfaces 7, 8 may consist of a slit 11' (see FIG. 4) or a plurality of holes 11" (see FIG. 5) concentric with the refining discs 4, 5. The inlet openings of the passageways 11 are located in the outer portion of the refining discs 4, 5, preferably at a distance of between 40 and 150 mm from the periphery of the refining discs. 4, 5. However, in certain cases other locations are also possible. The passageways 11 are directed obliquely inward from the refining space 9 so that they form an angle with the plane of the refining surfaces 7, 8. The angle should be between 30 and 60°, preferably between 40 to 50°. The inlet openings of the passageways 11 from the refining space 9 are rounded at their edge closest to the center, with a radius of preferably between 1 and 10 mm. The remote or radially outer edge is bevelled or rounded. When using slit-shaped passageways 11, the slit width should be between 1 and 5 mm, and when using hole passageways, the hole diameter should be between 5 and 10 mm, depending on the number of holes. The holes may be arranged in one or several concentric rows. From a manufacturing point of view, holes are to be preferred because slits require the refining surface to be divided or alternatively require that special pieces be inserted at casting.

Figure 2:
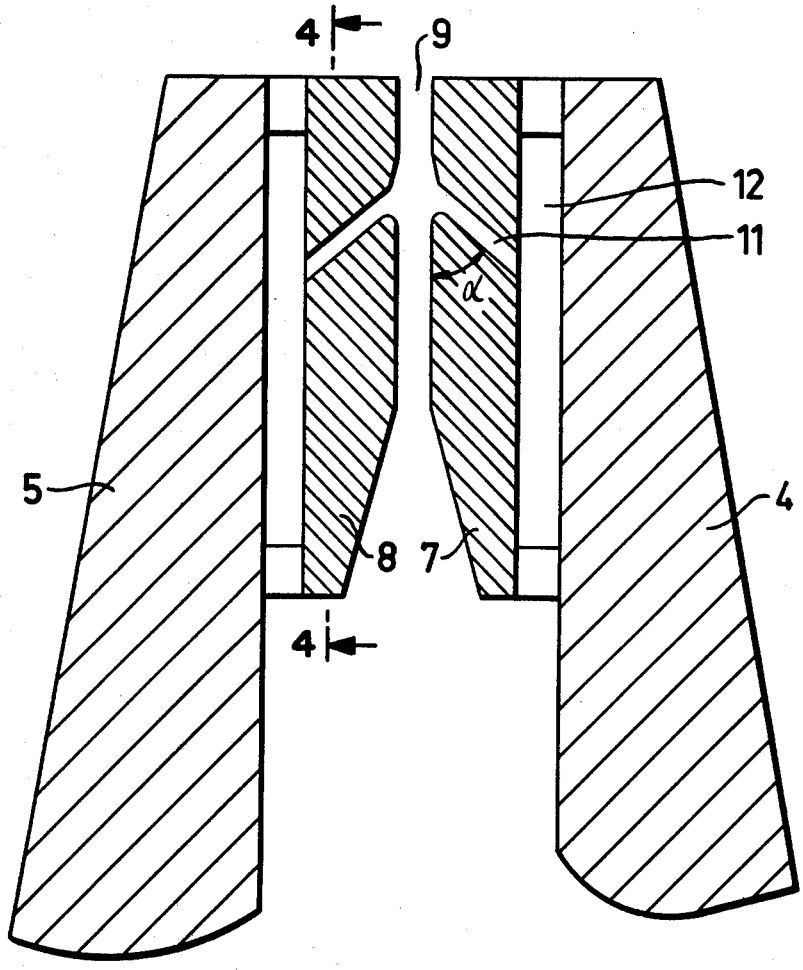
FIGS. 2 and 3 are enlarged partial sectional views of two embodiments of the refining discs according to the present invention showing the refining space defined therebetween.
Figure 3:
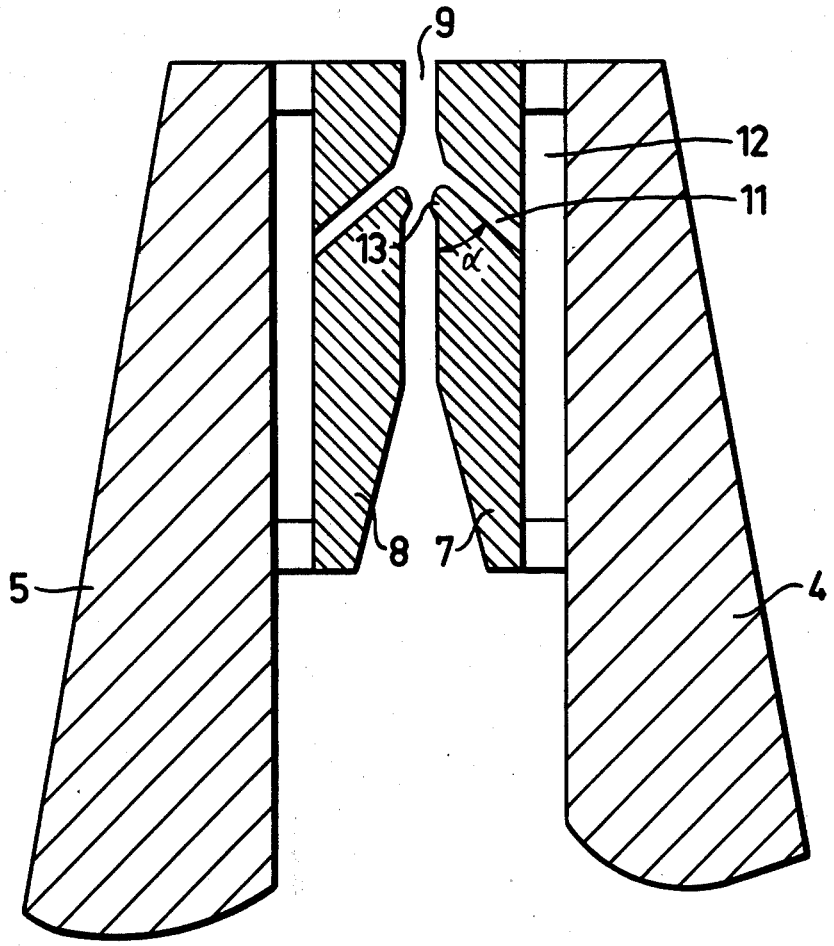

FIGS. 2 and 3 show two embodiments for the refining surfaces according to the present invention. According to FIG. 3, the edge located closest to the center (i.e., upstream, relative to the direction of flow, of the passageway 11) is formed with restrictor means or a projecting threshold 13, the forward edge of which is bevelled so as to form an angle of 15–45° and preferably an angle of approximately 30°, with the plane of the refining surface.

During the refining operation, a great portion of the steam developed in the refining space 9 flows out through the passageway 11 in the refining surfaces 7, 8 and thereby reduces the disturbing effect of the steam on the refining process. The steam amount flowing out through the passageways 11 is preferably equal to the amount flowing out through the refining space 9. Due to the oblique inward direction of the passageways 11, the steam flow will be deflected radially inwardly. This, in combination with the effect of centrifugal force, substantially prevents the fiberous material from also flowing through the passageways 11, which thereby keeps the passageways 11 clean of fiberous material. The threshold 13, according to FIG. 3, additionally makes it difficult for the fiberous material to follow with the steam flow through the passageways 11, thus preventing clogging of the openings.

With passageways in the form of a slit of about 3 mm or a corresponding hole area, only fiberous material with a specific surface exceeding about 100 $m^2/kg$ can be taken along by the steam flow through the passageways 11. This would correspond to very fine fiber fragments. When the passageway dimension and the deflection are chosen in a suitable way, it is possible to a certain extent also to separate off completely refined pulp through the passageways 11. The main object of the invention, however, is to withdraw steam from the refining space 9 through the passageways 11. Further, it is to be noted that due to the steam withdrawal, the temperature in the refining space decreases, the space for the fiberous material is enlarged, and there is less risk of vibrations. This implies, in addition to a more uniform refining, an increase in the brightness of the pulp.

While the preferred embodiment of the present invention has been shown and described, it will be understood that such is merely illustrative and that changes may be amde without departing from the scope of the invention as claimed.

What is claimed is:

1. A method of refining fiberous material in a disc refiner, the disc refiner having a pair of refining discs each of which includes an inner refining surface, and the refining discs being mounted for rotation relative to one another within a housing with said inner refining surfaces of said refining discs opposing one another during said relative rotation and defining a refining space therebetween, the method comprising:

feeding fiberous material between said refining discs;

relatively rotating said refining discs so that said fiberous material passes radially outward through said refining space between said refining surfaces of said refining discs into said housing;

withdrawing at least a portion of the steam developed in said refining space from said refining space through a passageway provided in at least one of said refining surfaces of said refining discs, said passageway extending from said refining surface in a direction away from said refining space and communicating with said housing; and passing said withdrawn steam directly into said housing without passing it through said refining space.

2. The method of claim 1 wherein the step of withdrawing comprises withdrawing at least a portion of the steam developed is said refining space through a passageway extending in a direction opposite to the direction that said fiberous material moves through said refining space.

3. The method of claim 1 or 2 wherein the step of withdrawing comprises withdrawing an amount of steam through said passageway which is equal to about one-half the amount of steam developed in said refining space.

4. The method of claim 1 further including withdrawing a portion of the fiberous material through said passageway during the step of withdrawing steam.

5. The method of claim 4 wherein the step of withdrawing a portion of fiberous material through said passageway comprises withdrawing only completely refined fiberous material through said passageway.

6. The method of claim 5 wherein the step of withdrawing a portion of fiberous material through said passageway comprises withdrawing only fine fiberous material through said passageway.

7. A disc refiner for refining fiberous material, said disc refiner comprising:

a housing;

first and second refining discs each of which includes an inner refining surface, said refining discs being mounted for rotation relative to one another within said housing with said inner refining surfaces of said first and second refining discs opposing one another to define a refining space therebetween; and conducting means for said first refining disc extending from said refining space and communicating with said housing for removing at least a portion of the steam developed in said refining space and conducting it directly into said housing without passing it through said refining space.

8. The disc refiner of claim 7 wherein said conducting means comprises a passageway in said first refining disc extending from said refining surface in a direction away from said refining space, and first communication means communicating with said passageway of said first refining disc for conducting steam away from said passageway without passing it through said refining space.

9. The disc refiner of claim 8 wherein said inner refining surfaces of said first and second refining discs are annular.

10. The disc refiner of claim 8 wherein said passageway in said first refining disc extends from said refining surface in a direction both away from said refining space and opposite to the direction that the fiberous material moves through said refining space.

11. The disc refiner of claim 8, 9 or 10 wherein said passageway extends in a direction forming an angle of between 30° and 60° with the plane of said refining surface.

12. The disc refiner of claim 8, 9 or 10 wherein said passageway in said first refining disc comprises an annular slit concentric with said refining surface of said first refining disc.

13. The disc refiner of claim 8, 9 or 10 wherein said passageway comprises a plurality of holes arranged in a circular pattern concentric with said refining surface of said first refining disc.

14. The disc refiner of claim 8 wherein said second refining disc includes a passageway extending from said refining surface thereof in a direction away from said refining space for withdrawal therethrough of at least a portion of the steam developed in said refining space, and further including second communication means communicating with said passageway of said second refining disc and with the interior of said housing for conducting steam withdrawn through said passageway of said second refining disc into said housing without passing through said refining space.

15. The disc refiner of claim 14 further including restrictor means on said refining surfaces of said first and second refining discs extending into said refining space for restricting the flow passage of said refining space thereat, said restrictor means being positioned upstream of said passageways in said refining surfaces of said first and second refining discs.

16. The disc refiner of claim 15 wherein said restrictor means comprises an annular threshold on each of said refining surfaces projecting into said refining space and disposed radially inward of said passageways.

* * * * *